United States Patent [19]

Koeln et al.

[11] 4,161,374

[45] Jul. 17, 1979

[54] TWIST RETRACTABLE WRITING IMPLEMENT

[75] Inventors: Harold E. Koeln, Kirkwood; Walter W. Paige, Jr., Crestwood, both of Mo.

[73] Assignee: Penn Corporation, Princeton, N.J.

[21] Appl. No.: 783,639

[22] Filed: Apr. 1, 1977

[51] Int. Cl.[2] ..... B43K 5/16; B43K 7/12

[52] U.S. Cl. ..... 401/116; 401/60; 401/98

[58] Field of Search ..... 401/62, 68,99, 102, 401/104, 116, 59, 60, 61, 64, 69, 73, 82, 86, 87, 98

[56] References Cited

U.S. PATENT DOCUMENTS

| | | | |
|---|---|---|---|
| 246,961 | 9/1881 | Livermore | 401/82 |
| 1,711,006 | 4/1929 | Alford | 401/116 X |
| 1,872,064 | 8/1932 | Cuthbert | 401/86 |
| 3,000,352 | 9/1961 | Grube et al. | 401/109 |
| 3,037,483 | 6/1962 | Caviglione | 401/104 |
| 3,292,592 | 12/1966 | Chapman et al. | 401/116 |

FOREIGN PATENT DOCUMENTS

| | | | |
|---|---|---|---|
| 634375 | 11/1927 | France | 401/98 |
| 788257 | 12/1957 | United Kingdom | 401/116 |

*Primary Examiner*—Clyde I. Coughenour

[57] ABSTRACT

A twist retractable writing implement wherein a cap threadably engages a barrel and supports a scribe element, rotation of said cap longitudinally displaces said scribe element with reference to the barrel alternatively into extended and retracted condition. An internally grooved annular flange with a tapered base forms a socket for mounting the scribe element to the cap and provides an air passageway to the seated end thereof. A non-circular bore adjacent the opening tip of the barrel receives the writing tip of the scribe element while providing an air passageway into the barrel.

5 Claims, 8 Drawing Figures

FIG. 1.
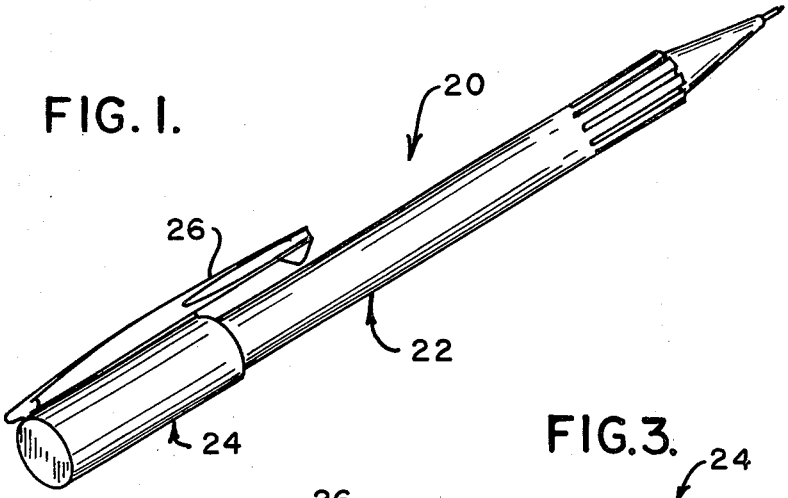
FIG. 3.
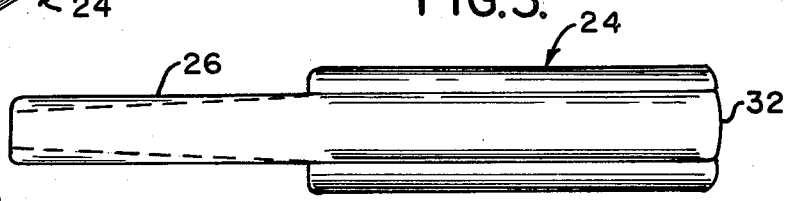
FIG. 8.
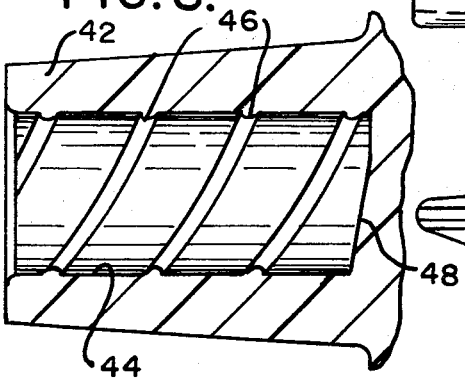
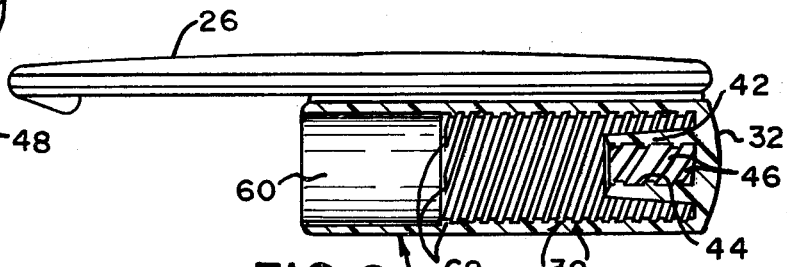
FIG. 2.
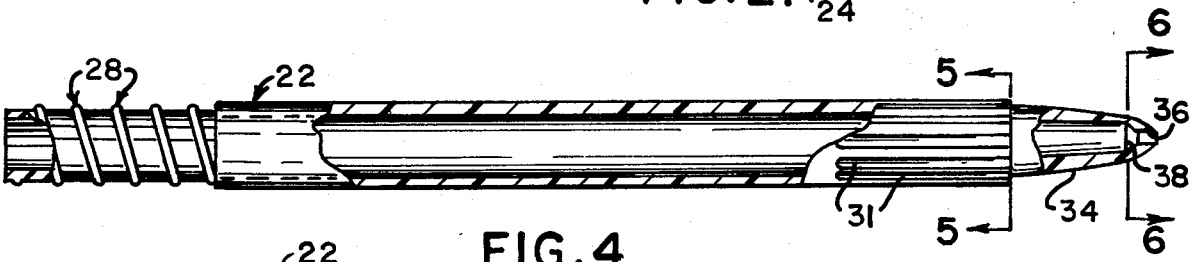
FIG. 4.
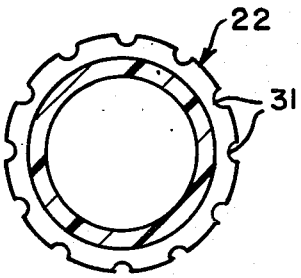
FIG. 5.
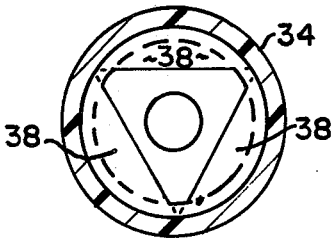
FIG. 6.
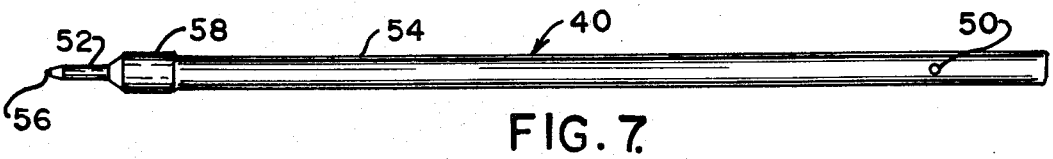
FIG. 7.

TWIST RETRACTABLE WRITING IMPLEMENT

This invention relates to a mechanical writing instrument which is extended and retracted by rotating the cap.

There have been twist-action writing implements in the past but mechanisms of this type have been complex, bulky or expensive. The present writing instrument overcomes all of the shortcomings of the prior art as will be seen in view of the following description.

Among the several objects of the present invention may be noted the provision of a mechanically simple, easily assembled and sturdy twist-action writing implement. Other objects and features will be in part apparent and in part pointed out hereinafter. The invention accordingly comprises the constructions hereinafter described, the scope of the invention being indicated in the subjoined claims.

In the accompanying drawings, in which one of various possible embodiments of the invention is illustrated, corresponding reference characters indicate corresponding parts throughout the several views of the drawings, and in which, FIG. 1 is a perspective view of a twist retractable writing implement in accordance with the present invention;

FIG. 2 is a side elevational view partly in longitudinal cross-section of the cap portion of the writing implement shown in FIG. 1;

FIG. 3 is a top plan view of the cap;

FIG. 4 is a side elevational view partly in longitudinal cross-section of the barrel portion of the writing implement shown in FIG. 1;

FIG. 5 is a cross-sectional view taken along line 5—5 in FIG. 4;

FIG. 6 is a cross-sectional view taken along line 6—6 in FIG. 4;

FIG. 7 is a side elevational view of the scribe element; and,

FIG. 8 is an enlarged longitudinal cross-sectional view showing that portion of the cap including the socket for holding the scribe element.

Referring now to the drawings, reference numeral 20 indicates a writing instrument shown as a ball point pen having a barrel 22 and a cap 24 with the usual pocket clip 26 affixed thereto. The upper end of barrel 22 and the lower end of cap 24 are cooperatively threaded at 28 and 30, respectively. One readily apparent function of threads 28 and grooves 30 is for joining the parts together. Other functions will be disclosed as the description proceeds.

As shown in FIGS. 1, 4 and 5, the outside of barrel 22 adjacent its lower end is provided with a plurality of equally spaced and parallel longitudinal grooves 31. Grooves 31 are provided to facilitate gripping of the writing instrument and are generally decorative.

While the ball drop of clip 26 as shown does not contact barrel 22, this is a matter of design choice. If contact is desired, the ball drop may be enlarged so that the free end of clip 26 is resiliently biased thereby against barrel 22.

Cap 24 comprises a tubular shell with a closed top 32. The inside diameter of cap 24 is substantially the same as the outside diameter of barrel 22. In assembled condition cap 24 is positioned over the upper end of barrel 22 and is rotatable relative thereto.

Barrel 22 comprises an open ended tubular shell with a downwardly converging wall 34 defining an opening tip 36. As best seen in FIGS. 4 and 6, wall 34 forms an abutment shoulder 38 with a triangular central bore adjacent opening tip 36. While shown as triangular, the bore at this point can take other non-circular configurations.

In addition to serving as a cover for barrel 22, cap 24 also functions as a carrier for scribe element 40. As shown in FIG. 2, a downwardly depending annular flange 42 is centrally disposed on the inside of cap top 32. Annular flange 42 with top 32 defines a socket 44 having a cylindrical bore for receiving the upper end of scribe element 40.

Annular flange 42 has internal double-lead helical threads 46 which provide a gripping surface for scribe element 40. As shown in FIG. 8, the base of socket 44 has a taper from center line. When scribe element 40 is seated in socket 44, an air passageway is provided by threads 46 and taper 48 to the upper end of the scribe element. The provision of such a passageway is necessary to prevent a plunger effect when scribe element 40 is inserted into socket 44. It also permits equalization of the air pressure in the scribe element as ink is used. Scribe element 40 is further provided with hole 50 for this purpose.

Scribe element 40 is of conventional construction and includes a cylindrical ink cartridge 52 covered with a plastic sleeve 54 and having a writing tip 56. The upper end of cartridge 52 is open. Adjacent writing tip 56, cartridge 52 defines a shoulder 58 against which plastic sleeve 54 is abutted. When scribe element 40 is inserted in socket 44, plastic sleeve 54 tends to take a set around threads 46 to more firmly seat the cartridge.

In assembled condition, scribe element 40 is coaxially mounted in barrel 22. At one end, it is supported by socket 44 and at the other by downwardly converging wall 34.

To assemble writing instrument 20, the upper end of scribe element 40 is inserted into socket 44. As shown in FIG. 2, lower end 60 of cap 24 is not threaded and serves to guide cap 24 as it is slipped over the upper end of barrel 22.

When the leading ones of threads 28 engage grooves 30, cap 24 is rotated clockwise with respect to barrel 22. As shown in FIG. 2, grooves 30 comprise triple-lead helical grooves 62. While a single-lead groove can be used, it is preferred that the grooves have multiple leads. With multiple leads, cross-threading occurs less frequently and assembly is easier since the cap orients itself on the barrel more readily. Also, when the cap is formed of plastic, there is less tendency for sink points to form in the cap since its tubular shell is more uniform in thickness.

As cap 24 is rotated clockwise, writing tip 56 of scribe element 40 is longitudinally displaced towards opening tip 36. Hence, it is seen that cap 24 serves as a retracting means for the scribe element as well as a mounting means therefor.

The forward progress of cap 24 is stopped when the inside of top 32 abuts the upper end of barrel 22. This occurs when writing tip 56 is fully extended as shown in FIG. 1. At the same time, the leading edge of cartridge shoulder 58 opposite sleeve 54 presses against abutment shoulder 38 adjacent opening tip 36. The triangular bore at opening tip 36 permits the free flow of air into the writing instrument. Since scribe element 40 is cylindrical, other non-circular configurations can be used for this purpose.

From the above, it is seen that scribe element 40 is sturdily supported when it is fully extended. When barrel 22 and cap 24 are formed from plastic, writing tip 56 does not back off during normal use.

By opposite rotation of cap 24, scribe element 40 is retracted. As seen, during retraction of writing tip 56, rotation of cap 24 is insufficient to unscrew it from barrel 22.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. In a twist retractable writing implement having a barrel and a cap threadably received thereon, a scribe element carried by said cap, rotation of said cap longitudinally displacing said scribe element with reference to the barrel alternatively into extended and retracted condition, wherein the cap and the barrel are tubular, said cap having a closed end and said barrel having a first open end and a second end which converges into an opening tip, said cap having an inside diameter substantially the same as the outside diameter of the barrel adjacent its open end, and wherein a socket is mounted on the closed end of the cap for receipt of the scribe element at its end opposite the writing tip, wherein the socket is an annular flange coaxial with the cap and depending from the closed end thereof, the improvement wherein the cap is cooperatively grooved spaced from its open end, said grooves having multiple leads and wherein the cap top abuts the open end of the barrel when the writing tip is fully extended.

2. The improved twist retractable writing implement according to claim 1 wherein the scribe element has a cylindrical writing tip and wherein the bore of the barrel is non-circular adjacent the opening tip.

3. The improved twist retractable writing implement according to claim 2 wherein the bore of the barrel adjacent the opening tip is triangular in cross-section and is coaxial with the barrel, said non-circular bore providing an abutment shoulder.

4. The improved twist retractable writing implement according to claim 3 wherein the scribe element includes an abutment shoulder adjacent the writing tip, said shoulder of the scribe element in abutment with said shoulder of the barrel adjacent the opening tip when the writing tip is fully extended.

5. The improved twist retractable writing implement according to claim 4 wherein the annular flange has an internal helical groove with a multiple lead for proving an air passageway to the bottom of said socket.

* * * * *